US005199818A

United States Patent [19]

Yamamoto et al.

[11] Patent Number: 5,199,818

[45] Date of Patent: Apr. 6, 1993

[54] METHOD AND APPARATUS FOR DETECTING COLLAPSE OF NATURAL GROUND IN SHIELD DRIVING METHOD

[75] Inventors: Masahiko Yamamoto; Kanji Shibatani, both of Hiratsuka; Hiroaki Yamaguchi, Isehara; Yasuo Kanemitsu; Tetsuya Shinbo, both of Hiratsuka; Tomoyuki Abe, Fujisawa; Yasuhiko Ichimura; Shoichi Sakanishi, both of Hiratsuka, all of Japan

[73] Assignee: Kabushiki Kaisha Komatsu Seisakusho, Tokyo, Japan

[21] Appl. No.: 773,560

[22] PCT Filed: Mar. 8, 1991

[86] PCT No.: PCT/JP91/00317

§ 371 Date: Nov. 6, 1991

§ 102(e) Date: Nov. 6, 1991

[87] PCT Pub. No.: WO91/14078

PCT Pub. Date: Sep. 19, 1991

[30] Foreign Application Priority Data

Mar. 9, 1990 [JP] Japan ..... 2-58373

[51] Int. Cl.[5] ..... E02D 5/00; E21D 9/00

[52] U.S. Cl. ..... 405/142; 405/141; 405/272

[58] Field of Search ..... 405/138, 141, 142, 146, 405/272; 37/DIG. 1

[56] References Cited

U.S. PATENT DOCUMENTS

| | | | |
|---|---|---|---|
| 4,384,807 | 5/1983 | Yamazaki | 405/141 |
| 4,482,270 | 11/1984 | Unger et al. | 405/138 X |
| 4,516,878 | 5/1985 | Rebhan | 405/138 X |
| 4,854,776 | 8/1989 | Hentschel et al. | 405/146 X |

FOREIGN PATENT DOCUMENTS

| | | |
|---|---|---|
| 157065 | 8/1985 | Japan . |
| 173294 | 9/1985 | Japan . |
| 38099 | 2/1986 | Japan . |
| 178689 | 8/1987 | Japan . |
| 134785 | 6/1988 | Japan . |
| 131186 | 9/1989 | Japan . |
| 278694 | 11/1989 | Japan . |

*Primary Examiner*—Dennis L. Taylor
*Assistant Examiner*—J. Russell McBee
*Attorney, Agent, or Firm*—Richards, Medlock & Andrews

[57] ABSTRACT

A method and an apparatus for performing measurement by a resistivity method in order to detect the thickness of a sludge layer on the outer periphery of a shield machine. A Wenner electrode row (14) on the outer periphery of the machine is used to measure reference resistivities to thereby detect certain resistivities in the depth direction of the natural ground and the sludge layer thickness. At the same time, a dipole electrode row (16) is used to measure voltage distributions in the depth direction of the natural ground and in the direction of the arrangement of the electrodes. The ratios of the values measured by the measurement dipole electrodes to those measured by the reference Wenner electrodes are calculated, and their distribution is charted. When mutually equal values in the distribution map are connected together by continuous curves, a contour-pattern image is obtained, which enables a configuration of the collapse of natural ground to be determined. Such as image can be displayed either two-dimensionally or three-dimensionally by image processing. If a plurality of sets of electrode rows (14) and (16) are arranged in the circumferential direction of the machine, and resistivities are detected while current having different frequencies is supplied, the collapse of the natural ground can be measured quickly.

10 Claims, 11 Drawing Sheets

METHOD AND APPARATUS FOR DETECTING COLLAPSE OF NATURAL GROUND IN SHIELD DRIVING METHOD

FIELD OF THE INVENTION

The present invention relates to a method and an apparatus for detecting a collapse of natural ground in a shield driving method and, more particularly, to a method and an apparatus for detecting a collapse of natural ground in a shield driving method that is suitable for detecting the thickness of a sludge layer existing between the shield machine and the natural ground, thereby detecting a collapse condition of the natural ground.

BACKGROUND ART

In general, in a shield driving method, any collapsed condition of the natural ground on the outer surface of the shield machine is detected from the viewpoint of, for instance, controlling the charge amount of a back filling. A resistivity method has been known as a method for such detection. For instance, Japanese Utility Model Laid-Open No. 1-131186 discloses a method in which a row of Wenner electrodes are provided on an outer surface of the shield machine, resistivities differing between various strata are detected, and the thickness of a sludge layer forming the first stratum is calculated on the basis of changes in the resistivities, thereby detecting a collapsed condition of the natural ground.

With this method, however, since the values of the measured resistivities are directly used, the characteristics of the electrodes influence the calculated thickness of the sludge layer even when the characteristics of the electrodes have deteriorated with the passage of time. Thus, it has been impossible to detect the thickness of a stratum with a high level of precision. In addition, with the method (described in the above-identified publication) in which a row of Wenner electrodes are employed, resistivity measurement is possible only at a point at a certain depth basically determined by the distance between the electrodes. When multi-point measurement is to be performed, a large number of electrodes must be used. However, when a large number of electrodes are used, it is necessary that the position of the electrode on the side of the power supply source be successively changed. Thus, operational efficiency is greatly deteriorated In addition, the fact that the current supplied to the stratum cannot be easily stabilized further deteriorates efficiency. For these reasons, the disclosed method has too many problems to be applied to a shield driving method which requires such a measurement operation to be performed within a short period.

Furthermore, it is very difficult to determine the configuration of a collapse with the above method.

SUMMARY OF THE INVENTION

The present invention has been accomplished in view of these problems An object of the present invention is to provide a method and an apparatus for detecting a collapse of natural ground in a shield driving method that is capable of precisely measuring resistivities, accurately determining the configuration of the collapse, and performing measurement within a short period of time.

In order to achieve the above object, a method for detecting a collapse of natural ground in a shield driving method according to the present invention primarily comprises: using a measurement electrode row of dipole electrodes and a reference electrode row of Wenner electrodes, which rows are provided on an outer surface of a shield machine; obtaining a measurement resistivity map from combinations of electrodes in the measurement electrode row and also obtaining a reference resistivity map corresponding to the measurement resistivity map by calculating, from the reference electrode row, certain resistivities of the natural ground and the thickness of a strata boundary; and obtaining a variation ratio map by calculating the ratios of measured values of the measurement resistivity map with respect to calculated values of the reference resistivity map, thereby detecting a collapsed condition of the natural ground.

An apparatus for detecting a collapse of natural ground in a shield driving method according to the present invention comprises: a measurement electrode row of dipole electrodes and a reference electrode row of Wenner electrodes, which rows are provided on a surface of a shield machine and connected to a constant current (or constant voltage) supply source and a voltage (or current) measuring device; reference signal calculating means for inputting a measurement signal from the reference electrode row, and for calculating a reference resistivity map by calculating certain resistivities of the natural ground and the thickness of a strata boundary; measurement signal calculating means for inputting a signal from the measurement electrode row, and for calculating a measurement resistivity map; and signal processing means for calculating the respective ratios between values of the measurement resistivity map and values of the reference resistivity map corresponding to the measurement resistivity map, and for transforming the ratios into a map. In the apparatus, the measurement dipole electrode row and the reference Wenner electrode row may be disposed parallel with each other; however, these electrode rows may also be disposed perpendicularly to each other. Further, the signal processing means may have means for calculating isopleths from the map containing the ratios between the values of the measurement resistivity map and the values of the corresponding reference resistivity map, and for outputting the isopleths. Still further, the output means may be connected with an image display means.

With the above-specified construction, the dipole electrode row enables a plurality of measurement points to be obtained only by changing the position of measurement electrodes while the current supply source remains fixed in place. Thus, when the measurement electrodes are moved with current supplying electrodes being moved a small number of times, multi-point measurement can be easily performed with respect to the natural ground in a matrix-like composition. In this way, the distribution of measurement voltage values corresponding to resistivities of the natural ground is obtained, and is transformed into a measurement resistivity map by calculation.

On the other hand, the Wenner electrode row performs measurement in the depth direction of the natural ground so as to allow the resistivities and the strata boundary thickness to be calculated by a k-d method or the like. Then, a reference resistivity map is calculated from the calculated values by a known calculation method, which map corresponds to the measurement resistivity map obtained with the dipole electrode row.

Because the measurement employing the Wenner electrode row is required to perform detection in the thickness direction of the strata, only a small number of operations are necessary to change the current supplying electrodes The results of this measurement are used as the reference.

On the basis of the results thus obtained, the ratios of the measured values of the measurement resistivity map with respect to the calculated values of the reference resistivity map are calculated to thereby prepare a variation ratio map. Thus, it is possible to obtain absolute variation values which are the result of offsetting a disturbance factor for the measured values, that is, the influence of the deterioration of the dipole electrodes with the passage of time, and which represent, in effect, a configuration of the collapse of the natural ground. Therefore, when the variation ratio map is read, it is possible to determine a collapse configuration, which is free from measurement errors or external disturbance, with a high level of precision.

In the above-specified method, if isopleths, each connecting equal variation ratios with each other, are obtained from orthogonal coordinate values in the calculated variation ratio map, and the isopleths are displayed as an image, it is possible to display a collapsed portion of the natural ground as a contour-line pattern. In this way, a collapsed portion can be easily recognized by visual sense so that collapse control can be easily performed by any person without requiring much skill.

When measurement points having equal values of ratios in the variation ratio map are connected with each other, an isopleth is obtained. Therefore, the following is also possible: data on such isopleths are inputted to the image processing means, and differences between levels which are proportional to the differences between the ratio values are provided to display a three-dimensional image. Such image processing can be easily performed by a three-dimensional tomography process employing a computer algorithm. In this way, a collapsed portion can be easily recognized by visual sense so that collapse control can be easily performed by any person without requiring much skill.

In carrying out the above-specified method, the reference Wenner electrode row may be disposed extending in the direction in which the shield machine advances. In this case, if the measurement dipole electrode row is disposed in parallel with the Wenner electrode row, the collapse configuration in the advancing direction is detected, whereas if the dipole electrode row is disposed perpendicular to the Wenner electrode row, the collapse configuration in the circumferential direction of the shield machine is detected. If necessary, the reference Wenner electrode row may also be disposed extending in the circumferential direction of the shield machine.

In another form of the present invention, a method for allowing a natural-ground collapsed condition to be quickly measured at a plurality of points in the circumferential direction of the shield machine is possible. Specifically, a method for detecting a collapse of natural ground in a shield driving method which is adapted to detect resistivities by supplying current to sludge on the periphery of a shield machine, and to detect any collapse of the natural ground on the basis of changes in the resistivities, comprises supplying currents having different frequencies into the sludge from a plurality of points in the circumferential direction of the shield machine, and obtaining voltage detection signals having the same frequencies as those of the currents, thereby detecting resistivities at the plurality of points.

An apparatus for carrying out this detection method comprises: electrode rows composed of conduction electrodes and detection electrodes, and arranged in correspondence with a plurality of points in the circumferential direction of the shield machine; a plurality of power sources connected to the conduction electrodes of the electrode rows, the power sources supplying currents having different frequencies to the conduction electrodes of the electrode rows; a plurality of filters connected to the detection electrodes of the electrode rows, the filters allowing the passage therethrough of voltage detection signals having the same frequencies as those of the currents supplied to the associated conduction electrodes; and a signal processor for calculating, on the basis of outputs of the filters, resistivities at the plurality of points in the circumferential direction of the shield machine.

With the above-specified construction, current having different frequencies are simultaneously supplied from the conduction electrodes of the electrode rows arranged in correspondence with a plurality of points in the circumferential direction of the shield machine into the sludge on the periphery of the shield machine. Then, the voltages generated by the currents supplied into the sludge are detected by the detection electrodes of the electrode rows. Among the detection signals outputted by the detection electrodes, those detection signals having the same frequencies as the frequencies of the currents supplied into the sludge are extracted. The detection signals which are thus extracted and which have mutually different frequencies are processed by the signal processor, whereby combined resistivities of the respective resistivities of the sludge and the natural ground are calculated. The combined resistivities is monitored to detect the condition of the working face.

In this way, the detection signals having different frequencies can be substantially simultaneously processed by the signal processor. Therefore, the condition of the natural ground in the circumferential direction of the shield machine can be detected quickly and in a real time manner, thereby making it possible to correctly cope with changes in the condition of the working face.

DETAILED DESCRIPTION

Specific embodiments of methods and apparatuses for detecting a collapse of natural ground in a shield driving method according to the present invention will now be described in detail with reference to the drawings.

Figure 1A:
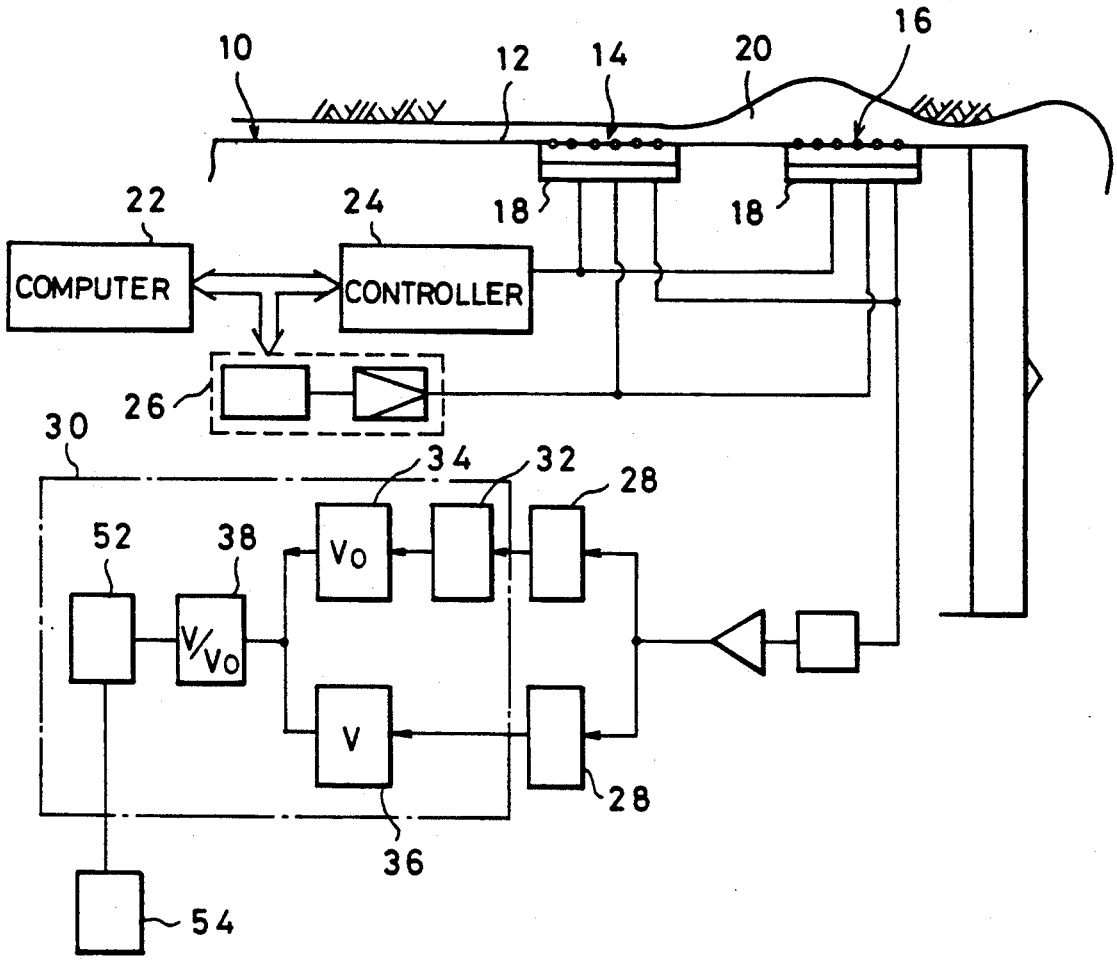
FIG. 1(A) is a block diagram showing the construction of an apparatus for detecting a collapse of natural ground in a shield driving method according to an embodiment of the present invention, FIG. 1(B) being a plan view showing an arrangement of electrodes, FIG. 1(C) being a plan view another of arrangement of electrodes.

FIG. 1 is a block diagram showing the construction of an apparatus for natural-ground collapse detection according to the present invention, the apparatus being applied to a sludge shield driving method. As shown in this drawing, a reference electrode row 14, consisting of a row of Wenner electrodes, and a measurement electrode row 16, consisting of a row of dipole electrodes, are mounted on an outer surface of a skin plate 12 of a shield machine 10. A relay box 18 is attached to each of the electrode rows 14 and 16 The reference electrode row 14 is such that the electrodes are interchangingly used in order to perform resistivity detection by the Wenner method. As shown in FIG. 2(B), from among the electrodes arranged at equal intervals, a pair of electrodes at outer positions serve as current supplying electrodes 14A while a pair of electrodes at inner positions serve as voltage detecting electrodes 14B. On the other hand, the measurement electrode row 16 is such that, as shown in FIG. 2(B), a dipole electrode row is formed with a pair of mutually adjacent electrodes serving as current supplying electrodes 16A and another pair of mutually adjacent electrodes spaced apart from the first pair by a predetermined distance serving as voltage detecting electrodes 16B. The relay boxes 18 serve to change the combinations of these electrodes The reference electrode row 14 is adapted to detect resistivities in the depth direction of the natural ground and the layer thickness of a sludge layer 20 forming the first stratum, and to calculate a reference resistivity map $M_B$. On the other hand, the measurement electrode row 16 is adapted to directly calculate a measurement resistivity map Ms with respect to a plurality of points. The switching of the electrodes is effected by a controller 24 controlled by a computer 22.

Figure 3:
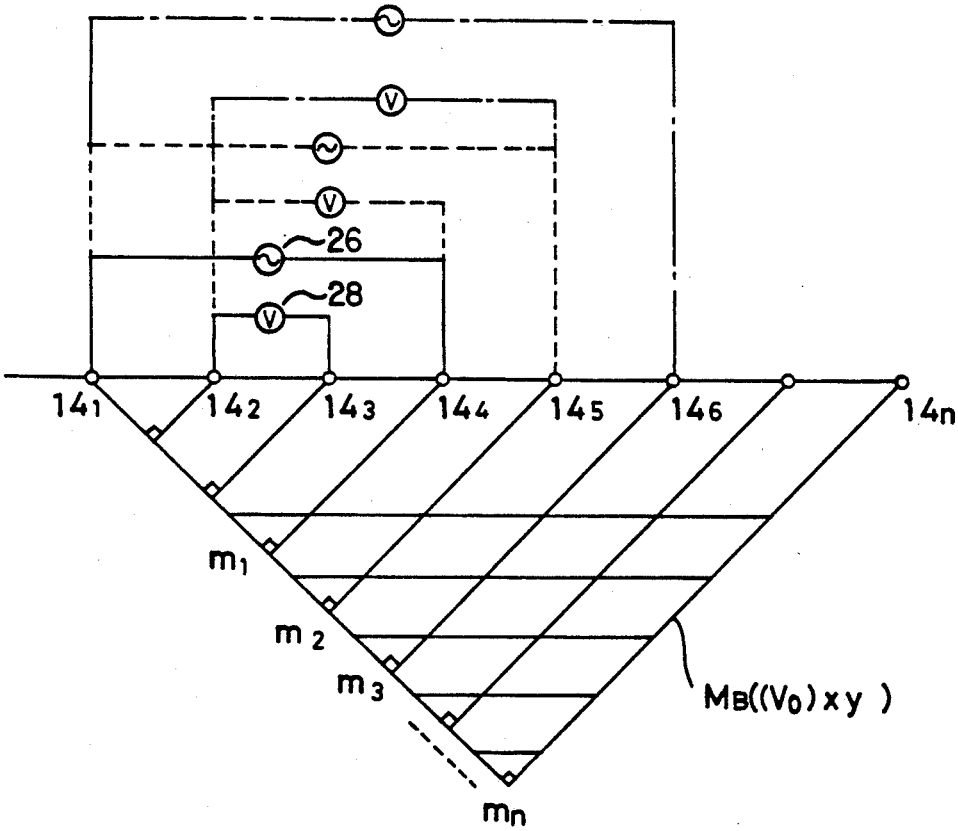
FIG. 3 is a view for illustrating a measurement method employing a reference electrode row as well as a reference resistivity map $M_s$ obtained by the method.

A method of detection by the reference electrode row 14 consisting of a Wenner electrode row will be described. As shown in FIG. 3, from among a plurality of electrodes $14_1$, $14_2$. . . and $14_n$, four electrodes $14_1$, $14_2$, $14_3$ and $14_4$ are selected. A pair of electrodes $14_1$ and $14_4$ at the outer positions are connected to a constant current supply source 26 to serve as current supplying electrodes 14A, while another pair of electrodes $14_2$ and $14_3$ at the inner positions are connected to a voltmeter 28 to serve as voltage detecting electrodes 14B. This arrangement allows a resistivity at a point $m_1$ at a depth determined by the distance between the current supplying electrodes 14A to be detected. When the electrodes serving as the current supplying electrodes 14A are changed in a manner such as that indicated in FIG. 3 by the broken lines or the one-dot-chain lines, it is possible to detect a resistivity another point $m_2$, $m_3$, . . . or $m_n$ at a certain depth. The values thus obtained are plotted on a reference curve according to a known Wenner method, and the resistivity $\rho_1$ of a sludge layer, the resistivity $\rho_2$ of the natural ground and the thickness $d_0$ of the sludge layer are calculated by a known k-d method. For this purpose, a detection signal is inputted to a signal processor 30. A signal from the reference electrode row 14 is fed to a k-d method processing means 32, and the calculated resistivities $\rho_1$ and $\rho_2$ and the calculated sludge layer thickness $d_0$ are outputted to a calculating section 34. The k-d method processing means 32 and the calculating section 34 constitute reference signal calculating means.

Figure 4:
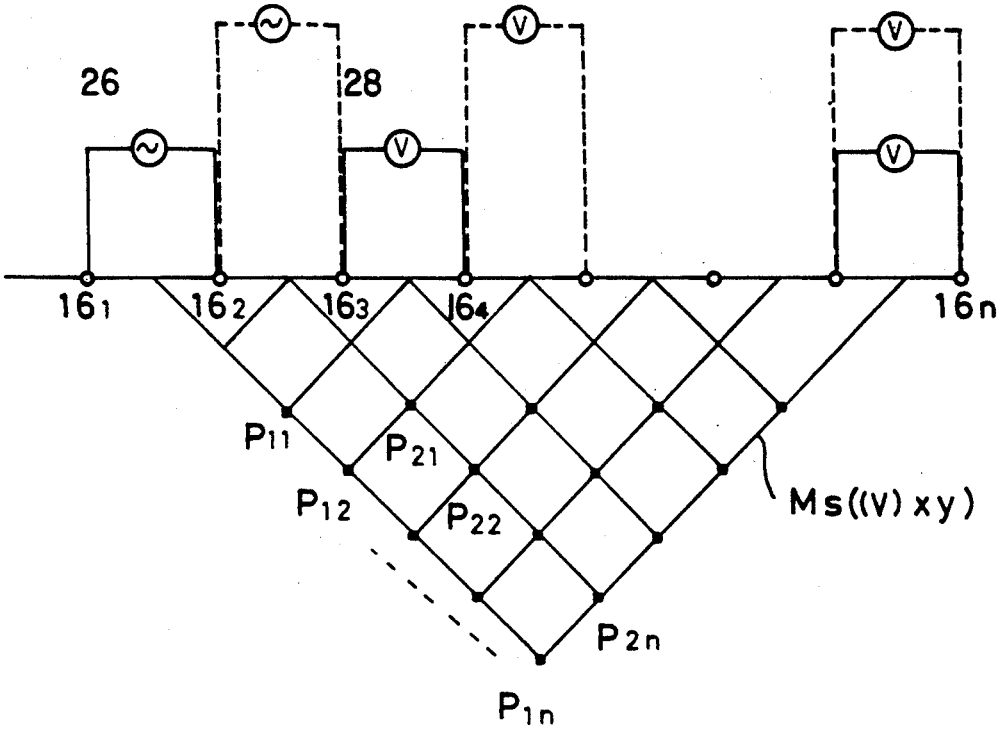
FIG. 4 is a view for illustrating a measurement method employing a measurement electrode row as well as a measurement resistivity map Ms obtained by the method.

On the other hand, the measurement electrode row 16 consisting of a dipole electrode row performs detection by the following method. As shown in FIG. 4, from among a plurality of electrodes $16_1$, $16_2$, . . . and $16_n$ arranged at fixed intervals, four electrodes $16_1$, $16_2$, $16_3$ and $16_4$ are selected. A first pair of mutually adjacent electrodes $16_1$ and $16_2$ are connected to the constant current supply source 26 to serve as current supplying electrodes 16A, while a second pair of mutually adjacent electrodes $16_3$ and $16_4$ are connected to a voltmeter 28 to serve as voltage detecting electrodes 16B. This arrangement allows the detection of a certain voltage corresponding to a resistivity at a point $P_{11}$ which is as deep as the middle point between the two electrode pairs is distant from each of the middle points between the individual electrode pairs. When the electrodes serving as the voltage detecting electrodes 16B are successively changed, it is possible to successively detect voltages at other points $P_{12}$, $P_{13}$, . . . and $P_{1n}$ lying in the depth direction of the natural ground. Subsequently, when the current supplying electrodes 16A are shifted to an adjacent pair of electrodes $16_2$ and $16_3$, as indicated in the drawing by the broken lines, and then the voltage detecting electrodes 16B are changed in a similar manner to perform detection, it is possible to detect voltage values similarly at other points $P_{21}$, $P_{22}$, $P_{23}$, . . . and $P_{2n}$ lying in the depth direction. A measurement signal, obtained by each switching through the relay box 18, is fed one after another to a calculating section 36 (serving as measurement signal calculating means) so that a measurement resistivity map $M_s$ containing map data $V_{xy}$ is obtained, the items of the map data being arranged in a matrix shape, as shown in FIG. 4.

Figure 5:
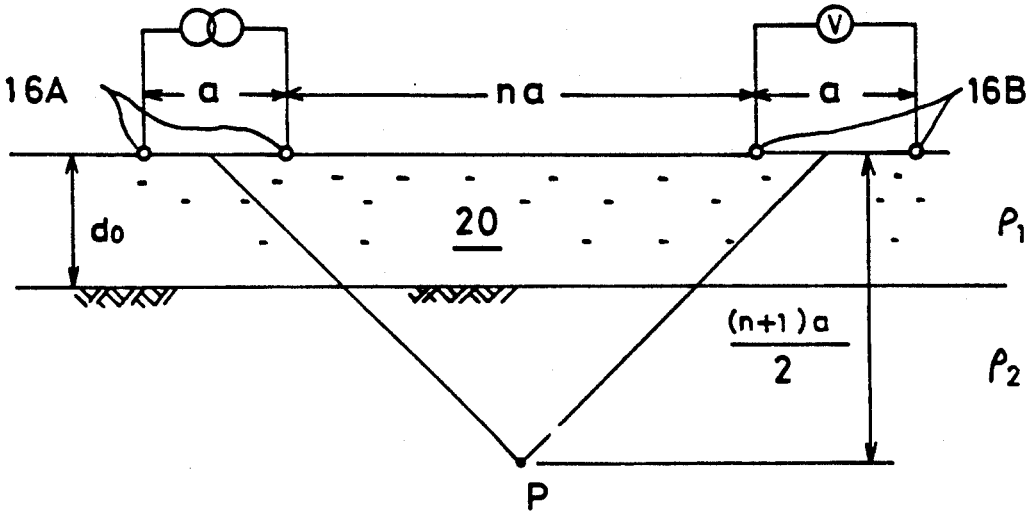
FIG. 5 is a view for illustrating the relationship between the electrode intervals in the dipole electrode row and a measurement point of the natural ground.

The calculating section 34, to which the signal outputted by the reference electrode row 14 is fed, calculates a reference resistivity map $M_B$ corresponding to the measurement resistivity map $M_s$. It is known that, in a dipole electrode row, the following formula stands when detection is performed with respect to two strata vertically adjacent to each other under the conditions of, as shown in FIG. 5, the current supplying electrodes 16A and the voltage detecting electrodes 16B having an inter-electrode interval of a, the electrode pairs having an inter-pair distance of na, the first stratum having a thickness of $d_0$, and the strata having resistivities of $\rho_1$ and $\rho_2$:

$$\frac{\rho_a}{\rho_1} = 1 + n(n+1)(n+2) \times \Sigma Q^k \left\{ \frac{1}{[n^2 + (2tk)^2]^{\frac{1}{2}}} - \frac{2}{[(n+1)^2 + (2tk)^2]^{\frac{1}{2}}} + \frac{1}{[(n+2)^2 + (2tk)^2]^{\frac{1}{2}}} \right\} \quad (1)$$

(where:
$\rho_a$ is the apparent resistivity expressed as $$\rho_a = \pi a n(n+1)(n+2)V/I \quad (2);$$

$t = d_0/a$; and
$Q = (\rho_2 - \rho_1)/(\rho_2 + \rho_1))$
When $k=1$ in the formula (1), $$\frac{\rho_a}{\rho_1} = 1 + n(n+1)(n+2) \times Q \left\{ \frac{1}{[n^2 + (2tk)^2]^{\frac{1}{2}}} - \frac{2}{[(n+1)^2 + (2tk)^2]^{\frac{1}{2}}} + \frac{1}{[(n+2)^2 + (2tk)^2]^{\frac{1}{2}}} \right\} \quad (3)$$

When V is calculated by substituting $\rho_a$ in formula (3) with the left side of the formula (2), $$V = \frac{\rho_1 I}{\pi a} \left[ \frac{1}{n(n+1)(n+2)} + Q \left\{ \frac{1}{[n^2 + (2tk)^2]^{\frac{1}{2}}} - \frac{2}{[(n+1)^2 + (2tk)^2]^{\frac{1}{2}}} + \frac{1}{[(n+2)^2 + (2tk)^2]^{\frac{1}{2}}} \right\} \right] \quad (3)$$

Here, as shown in FIG. 5, since the measurement point is at the depth of $(n+1)a/2 = y$, $n = (2y-a)/a$. Further, $2tk = 2d_0/a$. When these relations are used in the formula (3), it is rewritten as follows:

$$V + \frac{\rho_1 I}{\pi} \left\{ \frac{a^2}{(2y-a)2y(2y+a)} + \frac{\rho_2 - \rho_1}{\rho_2 + \rho_1} \left( \frac{1}{\sqrt{\{(2y-a)^2 + 4d_0^2\}}} - \frac{1}{\sqrt{\{y^2 + d_0^2\}}} + \frac{1}{\sqrt{\{(2y+a)^2 + 4d_0^2\}}} \right) \right\} \quad (4)$$

This formula enables map data $(V_0)_{xy}$ corresponding to the measurement resistivity map $M_s$ (obtained by the measurement by the dipole electrode row) to be obtained on the basis of data resulting from the measurement by the Wenner electrode row.

Figure 6:
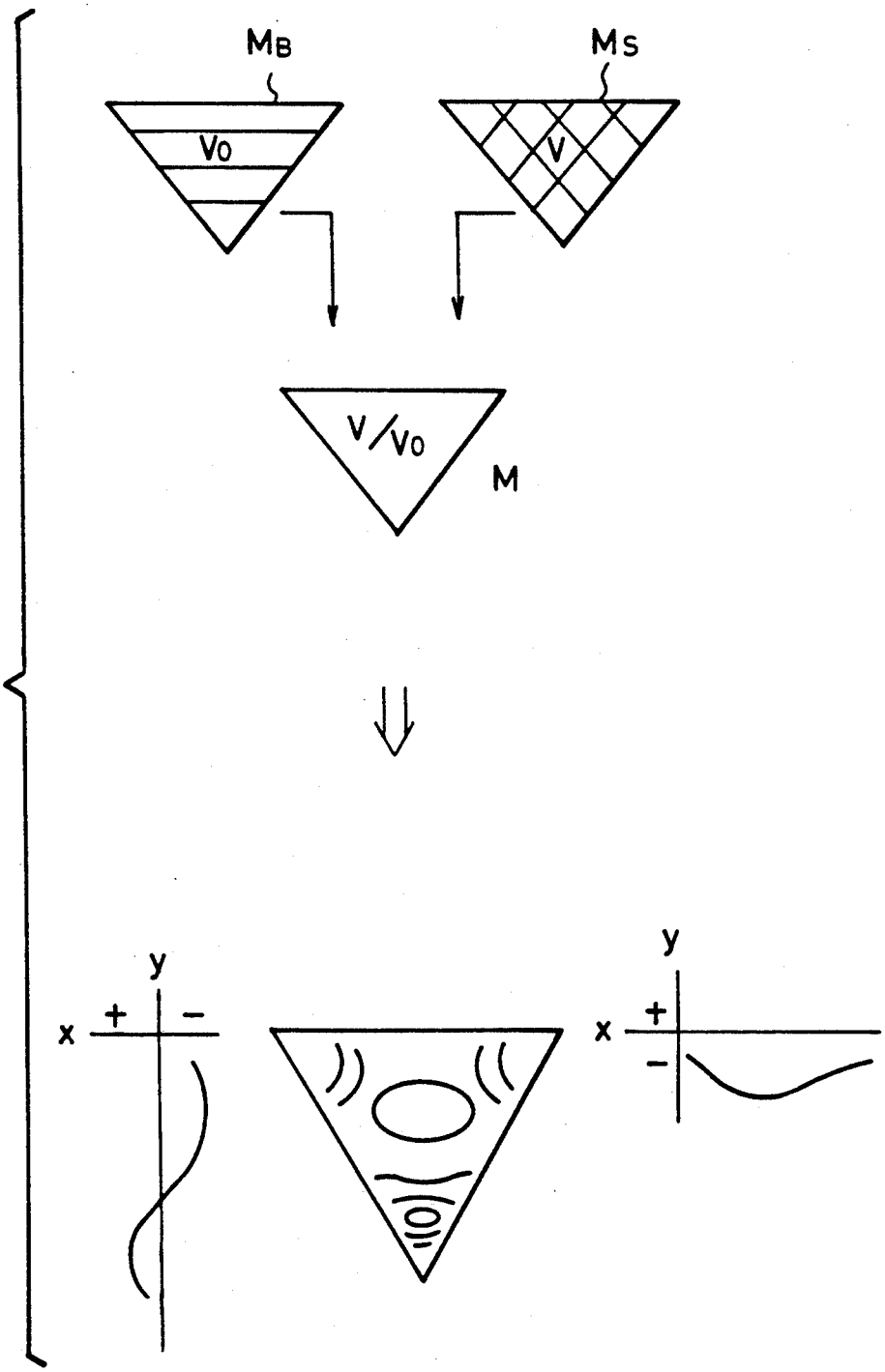
FIG. 6 is a view for illustrating the flow of data processing.

When the map data $(V)_{xy}$ and $(V_0)_{xy}$ are thus calculated by the calculating section 36 (serving as measurement signal processing means) and the calculating section 34, respectively, the data is inputted to a data processing section 38 for the subsequent stage, in which the respective ratios of items of the map data $V_{xy}$ of the measurement resistivity map $M_B$ with respect to items of the map data $(V_0)_{xy}$ of the reference resistivity map are calculated, to thereby calculate a variation ratio map M. The data of the measurement resistivity map $M_s$ constitutes multi-point data whose items are arranged in both the depth direction of the natural ground and the direction in which the electrodes are arranged. On the other hand, the data of the reference resistivity map $M_B$ constitutes layered data whose items are arranged in the depth direction. Therefore, the data processing section 38 performs, with respect to positions at each common depth of the natural ground, the division of measurement map data $V_{xy}$ by reference map data $(V_0)_{xy}$, and transforms the results of this division into a map output, as shown in FIG. 6. These results are outputted as a variation ratio map M from an external output device such as a printer. The outputted results show the variation ratios of the natural ground boundary surface being monitored by the dipole electrode row with respect to the average thickness of the sludge layer being monitored by the Wenner electrode row. The results also indicate a configuration of a natural ground collapse, if there is any.

Further, in this embodiment, the data of the variation ratio map M calculated by the data processing section 38 is outputted to a section analyzing means 52, which calculates isopleths by regarding the variation ratio map M as an orthogonal coordinate plane. The calculation is performed by a known image processing algorithm on the basis of the data of the variation ratio map M. The section analyzing means 52 outputs the analyzed data to an image display means 54 serving as an external output device, so that, when displayed on a monitor, the configuration of natural ground collapse can be visually recognized.

Figure 7:
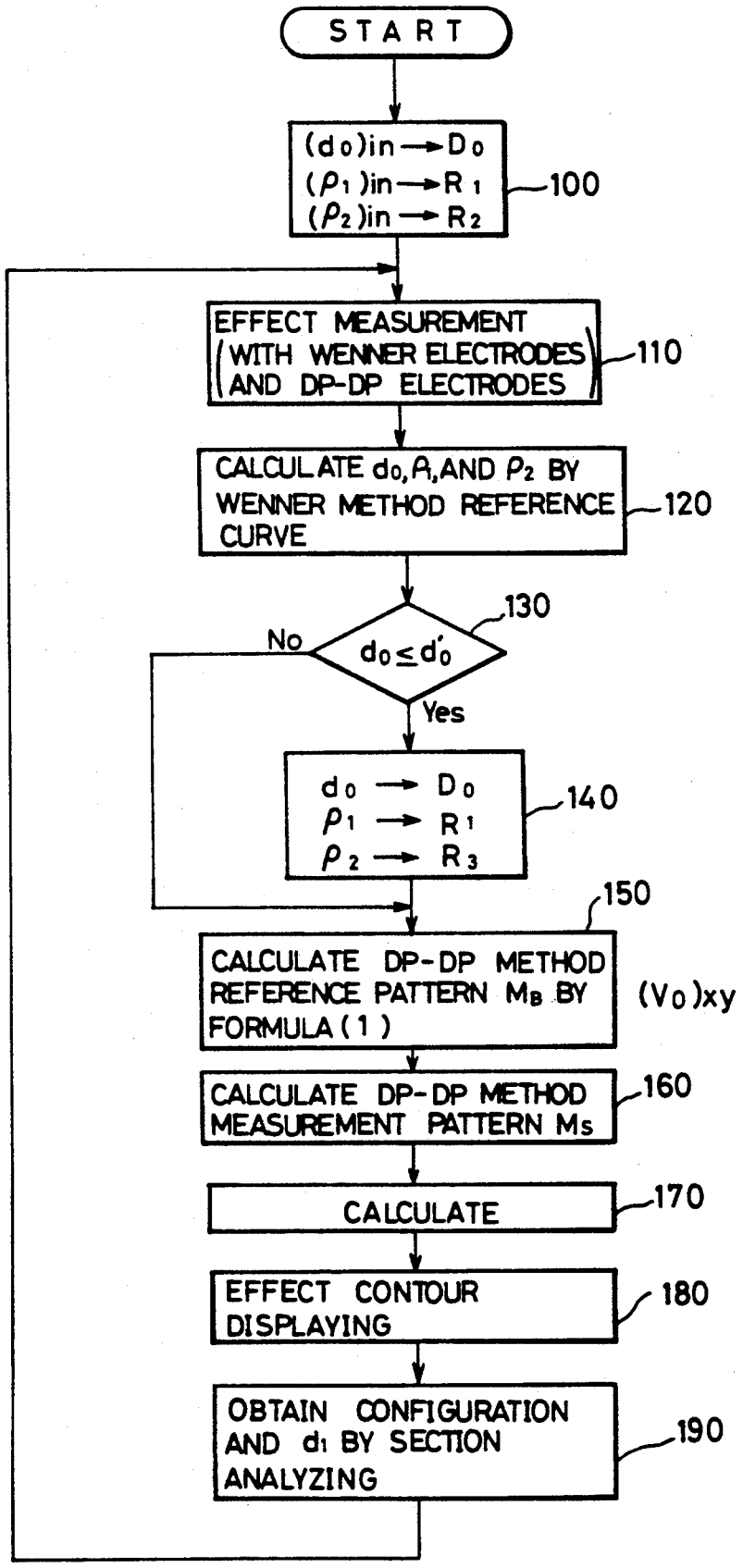
FIG. 7 is a flowchart showing the procedures of a method for detecting a collapse of natural ground in a shield driving method according to an embodiment.
Figure 8:
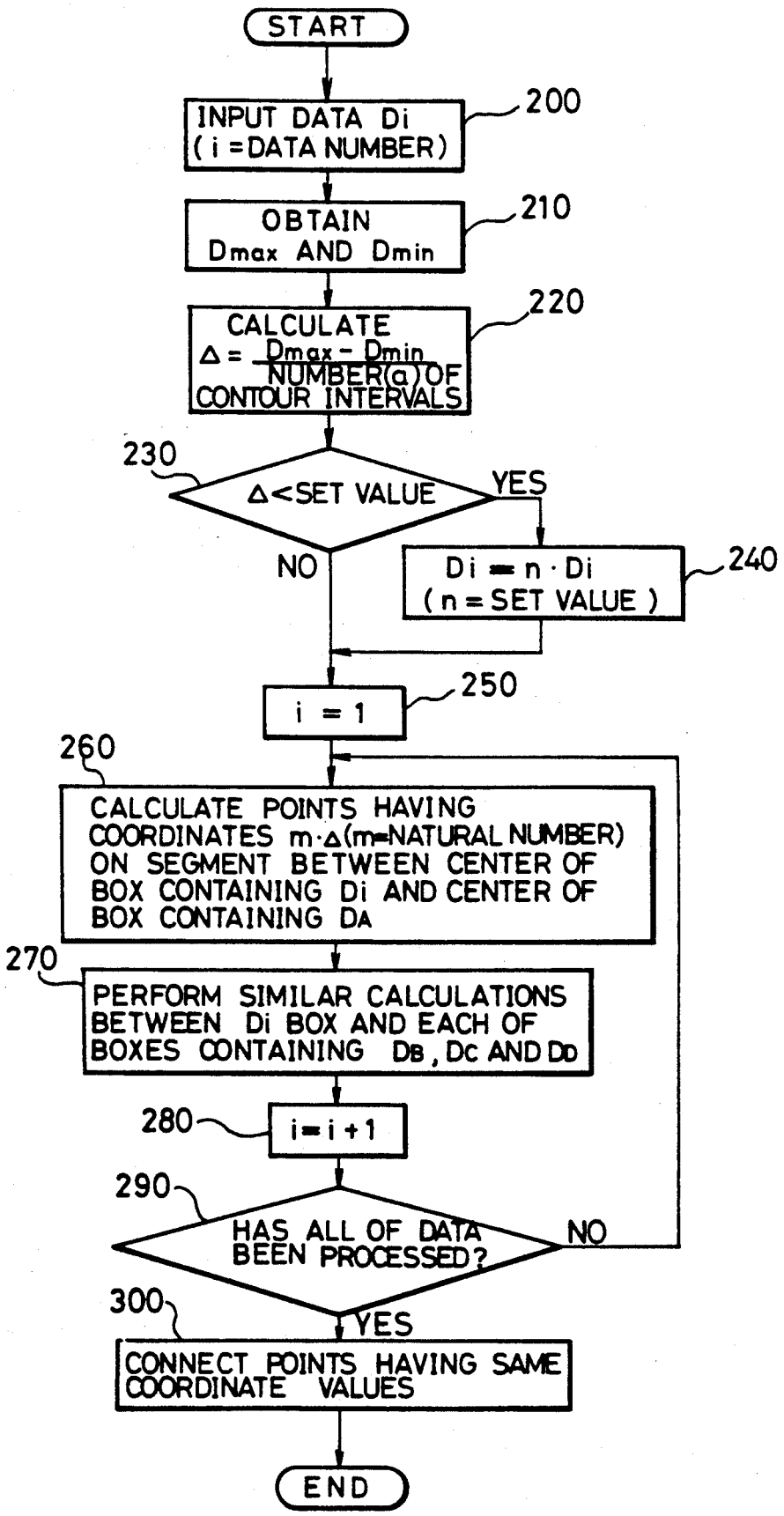
FIG. 8(A), FIG. 8(B), FIG. 8(C), FIG. 8(D), and FIG. 8(E) are respectively a flowchart for contour processing, and views for illustrating the processing.
Figure 8B:
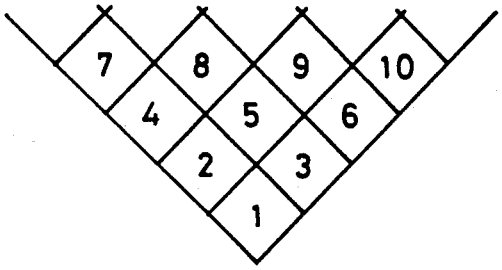

The flow of procedures by the apparatus for detecting a collapse of natural ground in a shield driving method according to the embodiment will be described with reference to the flowchart shown in FIG. 7. First, before measurement starts, initial setting is performed with respect to the sludge layer thickness $d_0$, the sludge layer resistivity $\rho_1$ and the natural ground resistivity $\rho_2$ (Step 100). When the initial setting has been completed, measurement employing the electrode rows 14 and 16 starts (Step 110). When measured data has been inputted, first, on the basis of an input signal from the reference electrode row 14, the sludge layer thickness $d_0$, the sludge layer resistivity $\rho_1$ and the natural ground resistivity $\rho_2$ are calculated by a k-d method and with reference to a reference curve (Step 120). Using the results of the calculation, the sludge layer thickness $d_0$ is compared with the initially set value (Step 130). If the measured sludge layer thickness $d_0$ is greater, the value is updated (Step 140), and then a reference resistivity map $M_B$ is calculated (Step 150); and if not, a reference resistivity map $M_B$ calculated from the values determined by the initial setting is maintained. Subsequently, a measurement resistivity map $M_s$ is calculated by a dipole method employing the measurement electrode layer 16 (Step 160), and then a variation ratio map M is calculated by the data processing section 38 (Step 170). The calculated map is printed when necessary, and is outputted to the section analyzing means 52 so that, through image processing, isopleths are displayed in a contour pattern (Step 180). Through section analyzing, a configuration of a collapse of the natural ground, the sludge layer thickness $d_1$, etc. are calculated (Step 190). Then, the program returns to Step FIG. 8(A), shows procedures for the contour displaying. Items of data Di of the variation ratio map M obtained as described above are numbered, as shown in FIG. 8(B), inputted, and stored (Step 200). The maximum value Dmax and the minimum value Dmin of the data Di are obtained (Step 210), and are used to calculate the following formula (Step 220):

$$\Delta=(D_{max}-D_{min})/a$$

(where a indicates the number of intervals between contours). This calculation allows the determination of a gradient variate in the variation ratio map M.

Figure 8C:
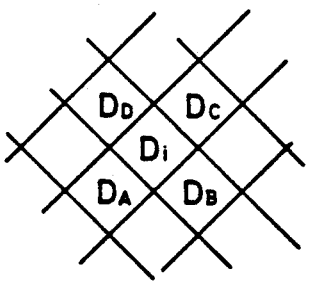
Figure 8D:
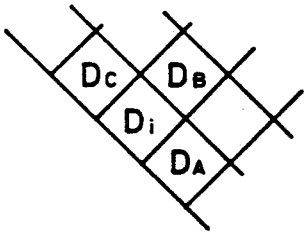
Figure 8E:
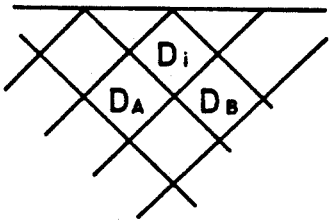

The calculated Δ is compared with a set value to determine whether or not it is possible to display the intervals between isopleths (Step 230). If Δ is below the set value, Δ is adjusted by a predetermined scale factor n (Step 240). Subsequently, a first item of the data $D_i$ is read (Step 250), and data boxes (for other items of data $D_A$, $D_B$, $D_C$ and $D_D$) are set in the periphery of a central box for the particular item of data $D_i$, as shown in FIG. 8(C). When the read data $D_i$ is positioned at an edge of the variation ratio map M, the boxes are set as shown in FIG. 8(D) or FIG. 8(E). Then, on the segment connecting together the center of the item of data $D_i$ and the center of a first adjacent item of data $D_A$, points having coordinates expressed as m·Δ (m being a natural number) are calculated (Step 260). This is because a segment between two adjacent items of data can be regarded as having changes occurring at a constant rate. Subsequently, similar calculations are performed on segments associated with the other items of data $D_B$, $D_C$ and $D_D$ (Step 270).

Thereafter, the number of the item of data $D_i$ is incremented (Step 280), and the necessary steps are repeated until all the items of the data have been processed (Step 290). When the series of calculations has been completed, the distribution of gradients between the items of the data $D_i$ becomes clear. Therefore, points having the same coordinate values are connected together (Step 300). The resultant data is outputted to the section analyzing means 52, then to the image display means 54 which performs contour displaying.

Next, description will be given concerning an embodiment in which the section analyzing means 52 performs a three-dimensional tomography process on the basis of the calculated data on isopleths. The intervals between isopleths obtained from a variation ratio map M indicate differences which are equivalent to those in resistivity, and which therefore correspond to the depth of a collapsed portion. Therefore, when the differences equivalent to those in resistivity are used as depth data, it is possible to express, on three-dimensional coordinates, a three-dimensional image of the configuration of the natural ground collapse.

Figure 9A:
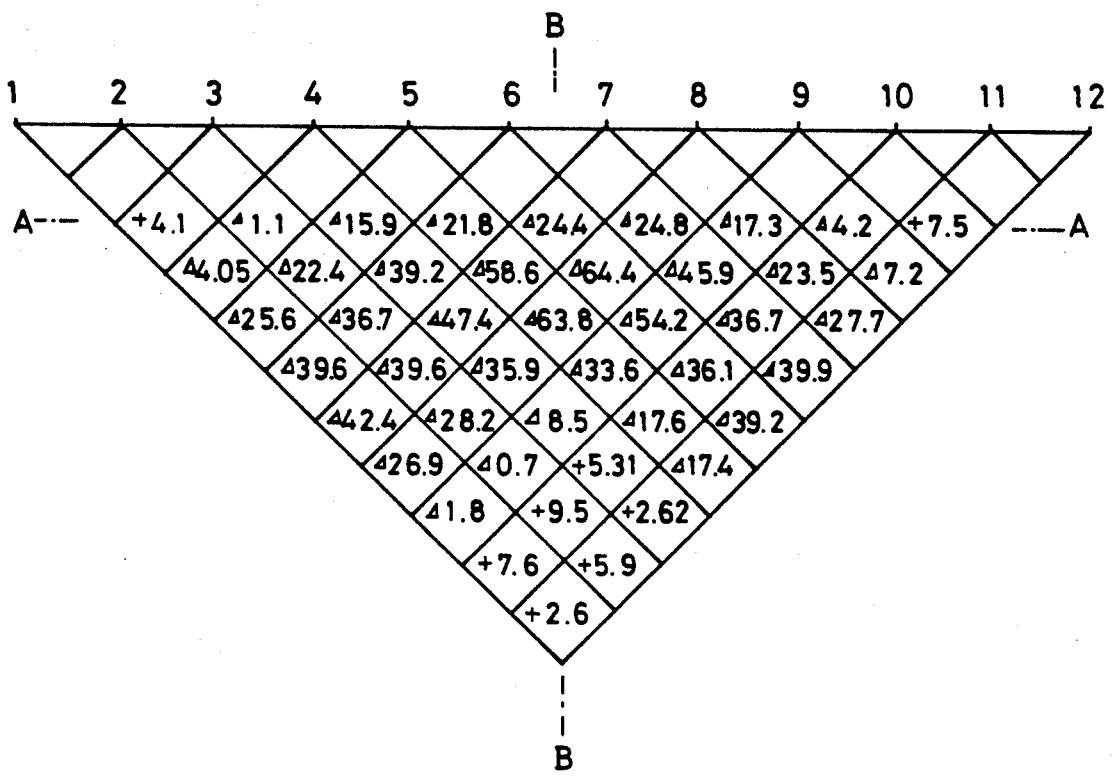
FIG. 9(A) shows experiment data of a variation ratio map M, FIG. 9(B) being a sectional view of a subject of measurement, FIG. 9(C) being a graph of data along orthogonal axes of the variation ratio map M.
Figure 9B:
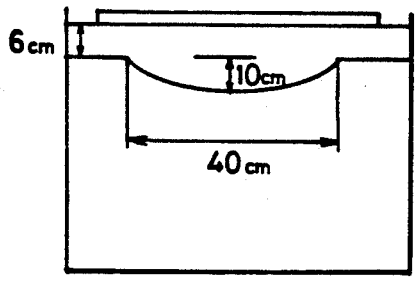
Figure 9C:
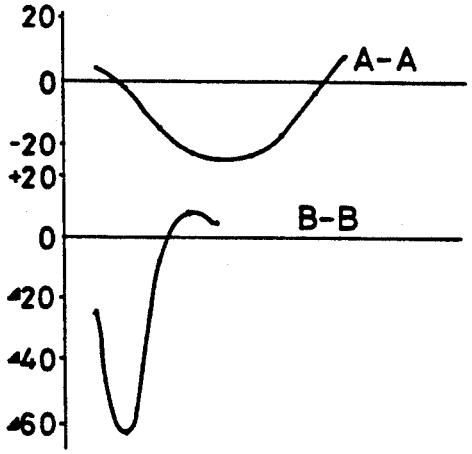
Figure 10:
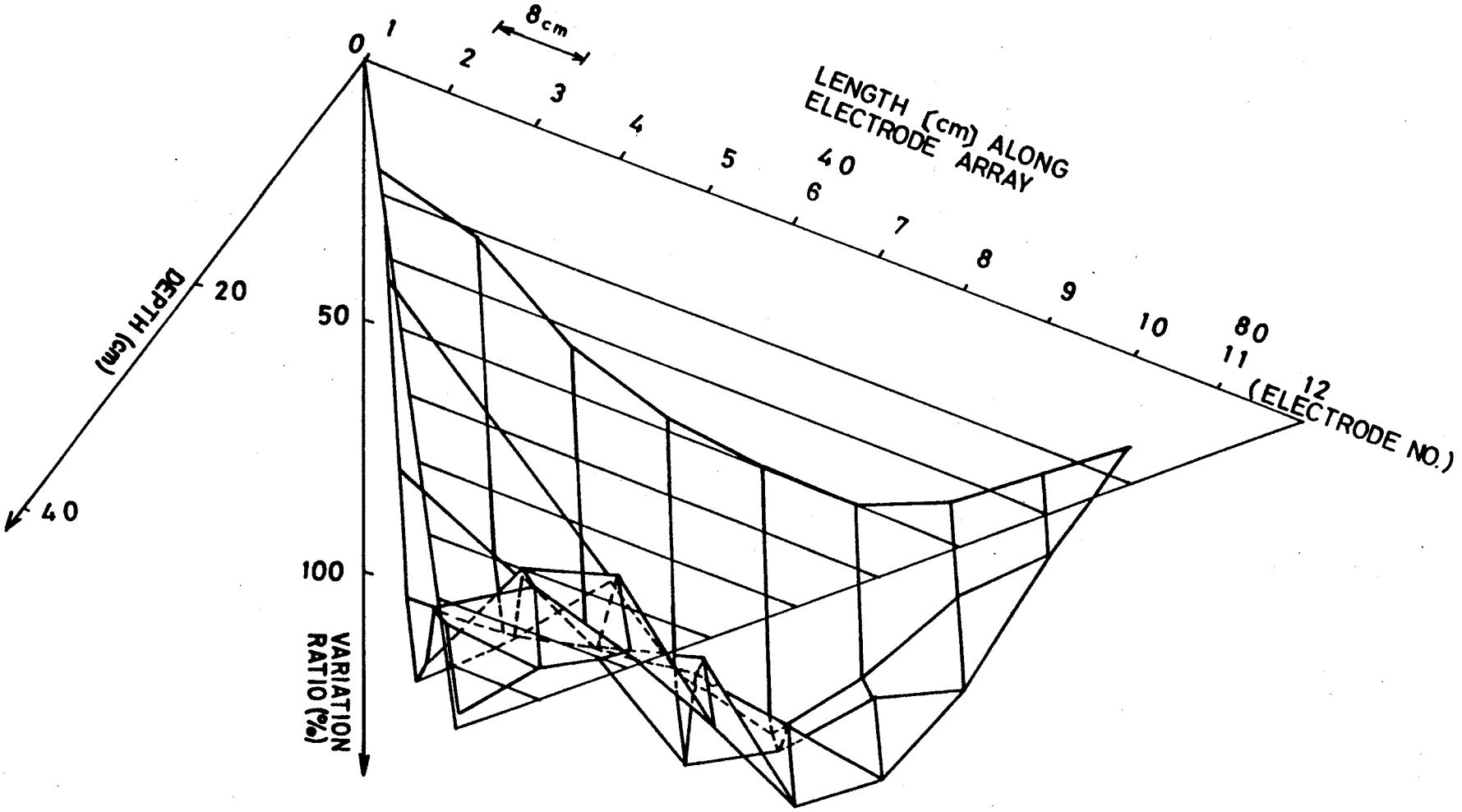
FIG. 10 shows an output example of a three-dimensional image of a collapse configuration (obtained by experiments)

A specific example of such a process will be described with respect to the measurement data shown in FIG. 9(A)/ The data is obtained by measuring a collapsed portion such as that shown in FIG. 9(B). A variation ratio map M shows items of measurement data whose number corresponds to the number of the electrodes. When those rows of items of data extending along orthogonal axes A—A and B—B in the variation ratio map M are each plotted in a graph against an axis of ordinate representing measurement current values, the data is expressed as shown in FIG. 9(C). Accordingly, when the plane data of the variation ratio map M is combined with an axis of ordinate representing the magnitude of the variation ratio to express the data in three-dimensional coordinates, a bird's-eye view corresponding to the configuration of the collapse (the subject of measurement) is obtained, as shown in FIG. 10. Although in this example, the values of the variation ratio map M are directly expressed on three-dimensional coordinates, the values can be expressed by continuous smooth curves on the assumption that the differences between the items of data change at a uniform rate. Such a three-dimensional process may be performed by a known computer algorithm, and a display can be easily effected with an image outputting means. When a three-dimensional image is displayed in the form of the so-called bird's-eye view thus obtained, it is possible to intuitively recognize the configuration of the collapse.

Figure 1B:
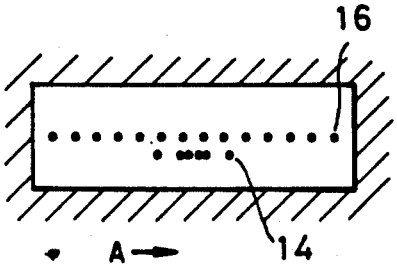
Figure 1C:
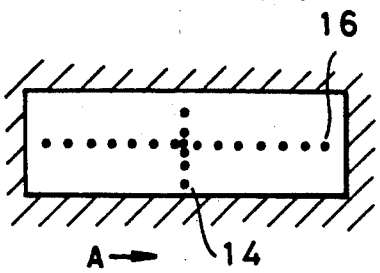
Figure 2A:
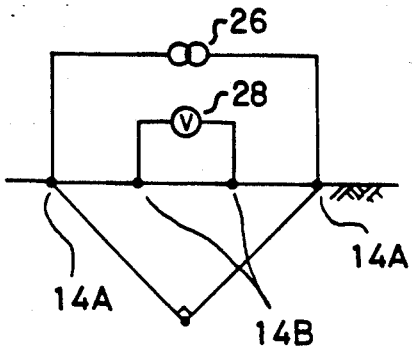
FIG. 2(A) and FIG. 2(B) are views for illustrating the principles of resistivity detection employing an Wenner electrode row and a dipole electrode row, respectively.
Figure 2B:
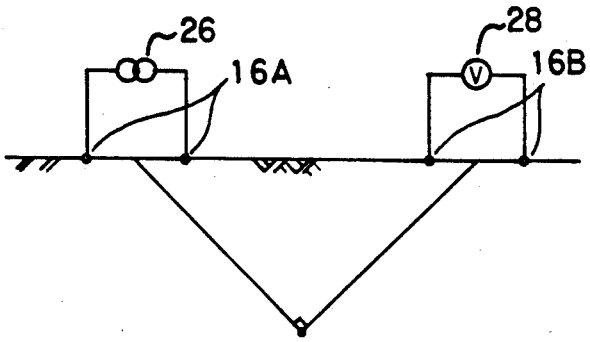

In the apparatus according to this embodiment, as shown in FIG. 1(B), both of the Wenner electrode row 14 and the dipole electrode row 16 are disposed in such a manner as to extend in the direction (indicated by the arrow A) in which the shield machine 10 advances, and these electrode rows are arranged in parallel with each other. With this arrangement, the configuration of the collapse of the natural ground is detected as a section along the advancing direction of the shield machine 10. However, if it is desired that the configuration of the collapse in the circumferential direction of the shield machine 10 be detected, the dipole electrode row 16 is disposed, as shown in FIG. 1(C), perpendicularly to the Wenner electrode row 14. It is, of course, possible to provide two dipole electrode rows 16 arranged perpendicularly to each other, and perform detection by suitably interchanging them. In this way, it is possible to simultaneously detect sectional configurations of the collapse in two different directions. If sets of data on these sectional configurations are obtained, it is possible to effect a three-dimensional display of the collapse configuration, and, through a three-dimensional tomography process, the display of a three-dimensional image is possible The Wenner electrode row 14 and the dipole electrode row 16 need not be provided at the same point, but they may, of course, be disposed at positions shifted from each other in the back-and-forth direction. In this case, the dipole electrode row 16 should preferably be disposed at a position closer to the forward end of the shield machine 10 from the viewpoint of an excavation process.

Next, an example of the construction of an apparatus for real-time measurement of a collapse of the natural ground in the circumferential direction of the shield machine will be described with reference to FIG. 11.

Figure 11:
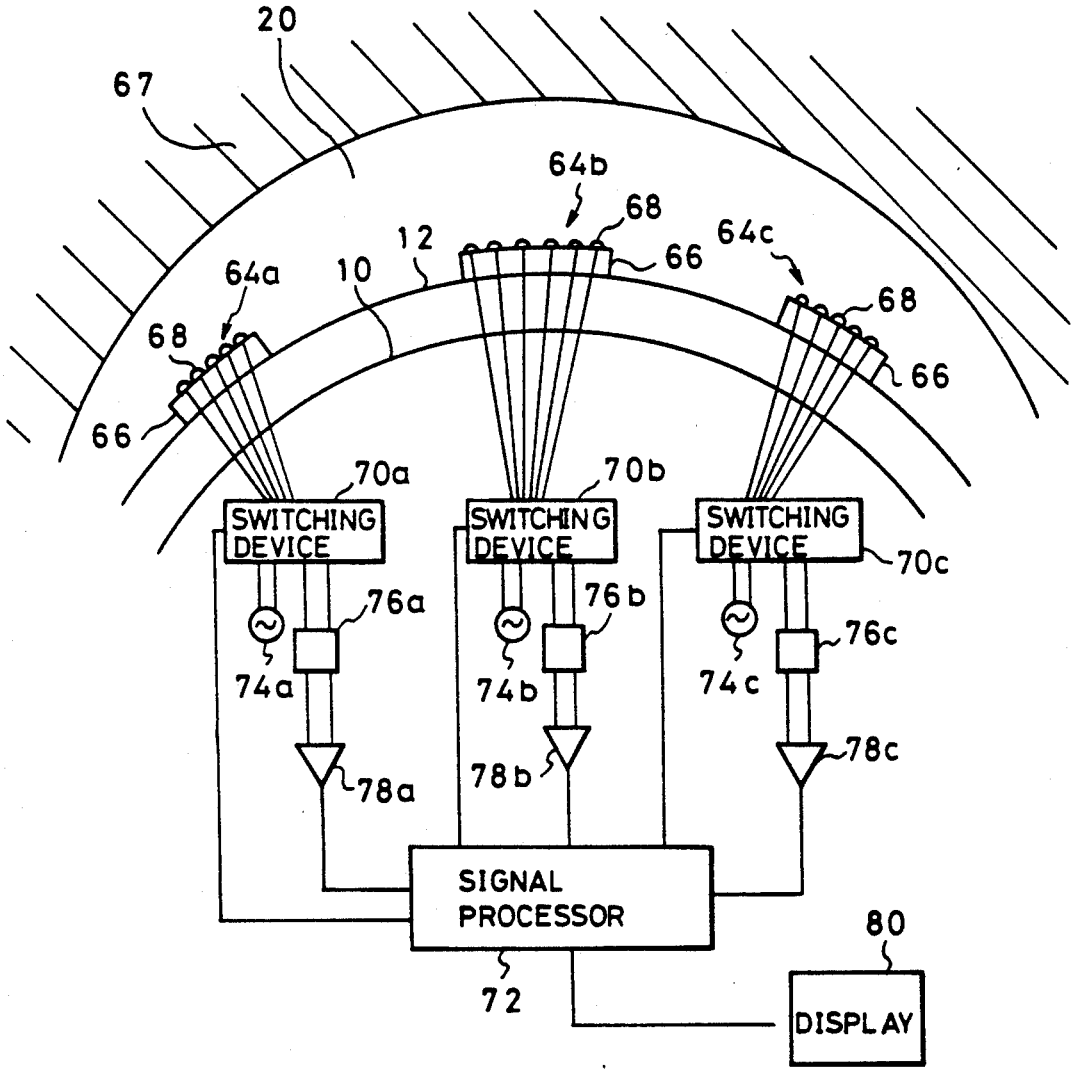
FIG. 11 is a view for illustrating an apparatus for detecting a collapse of natural ground in a shield driving method according to the present invention, the apparatus being adapted to supply current having different frequencies to sludge.

Referring to FIG. 11, a plurality of (three, in this embodiment) electrode row sets 64*a*, 64*b* and 64*c* are mounted on a skin plate 12 at a forward portion of a shield machine 10. The electrode row sets 64*a*, 64*b* and 64*c* are each a set of electrode rows having a structure such as that shown in FIG. 1(B) or FIG. 1(C), and are arranged at equal intervals of angle with respect to the center of the shield machine 10. The electrode row set 64*b* is positioned at a top portion of the shield machine 60. Each of the electrode row sets 64*a*, 64*b* and 64*c* is composed of: conduction electrodes for supplying current to a sludge layer 20 and a natural ground portion 67 which are on the periphery of the shield machine 10; and detection electrodes for detecting voltages based on the current. These electrodes are linearly arranged at equal intervals on insulators 66 fixed to the skin plate 12.

Electrodes 68 of each electrode row set 64a, 64b or 64c are connected to a switching device 70a, 70b or 70c such as a relay box. Each of the switching devices 70a, 70b and 70c is connected with a signal processor 72 so that a switching signal from the signal processor 72 causes a pair of electrodes, among the respective electrodes of each electrode row set 64a, 64b or 64c, to be interchangingly selected as conduction electrodes, and causes a pair of electrodes, among the remaining electrodes of each electrode row set, to be selected as detection electrodes. Each of the switching device 70a, 70b and 70c is connected to one of AC sources 74a, 74b and 74c and one of band filters 76a, 76b and 76c.

The output frequencies of the AC sources 74a, 74b and 74c are different from each other. For instance, these sources supply currents at 20 Hz, 30 Hz and 40 H, respectively, to the selected conduction electrodes of the individual electrode row sets 64a, 64b and 64c. On the other hand, the band filters 76a, 76b and 76c are connected to the detection electrodes of the individual electrode row sets 64a, 64b and 64c. The center frequency fe of each band filter accords with the output frequency of the associated AC source 74a, 74b or 74c; each band filter allows, among the voltages detected by the associated pair of detection electrodes, a detection signal having the frequency according with the output frequency of the AC source 74a, 74b or 74c to pass through the filter, and sends the signal to one of amplifiers 78a, 74b and 74c. The amplifiers 78a, 78b and 74c are connected, at their output sides, with the signal processor 72 so that the signal processor 72 receives the outputs of the amplifiers 78a, 78b and 78c, calculates combined resistivities of resistivities of the sludge layer 20 and resistivities of the natural ground portion 67.

The embodiment having the above-described construction operates in the following manner.

The signal processor 72 supplies a switching signal to each of the switching devices 70a, 70b and 70c so that, for example, a pair of electrodes at outermost positions of each electrode row set 64a, 64b or 64c are selected as conduction electrodes, thereby connecting the conduction electrodes to the AC source 74a, 74b or 74c; this connection causes AC current at 20 Hz to flow between the conduction electrodes of the electrode row set 64a, AC current at 30 Hz to flow between the conduction electrodes of the electrode row set 64b, and AC current at 40 Hz to flow between the conduction electrodes of the electrode row set 64c, all the flows of current taking place through the sludge layer 20 and the natural ground portion 67.

Also, the signal processor 72 selects, through the switching devices 70a, 70b and 70c, another pair of electrodes as detection electrodes from among the electrodes than the conduction electrodes, thereby connecting the detection electrodes to the band filters 76a, 76b and 76c. The pairs of electrodes of the electrode row sets 64a, 64b and 64c detect the voltages across the individual electrode pairs, and output detection signals corresponding to the magnitude of the voltages to the band filters 76a, 76b and 76c.

As described above, the center frequencies of the band filters 76a, 76b and 76c respectively accord with the output frequencies of the AC sources 74a, 74b and 74c. Therefore, among the inputted detection signals, a signal at 20 Hz is passed through the band filter 76a, a signal at 30 Hz is passed through the band filter 76b, and a signal at 40 Hz is passed through the band filter 76c, and then the signals are sent to the amplifiers, 78a, 78b and 78c, respectively. The amplifiers 78a, 78b and 78c amplify the inputted signals, and send them to the signal processor 72.

The signals processor 72 inputs the respective output signals of the amplifiers 78a, 78b and 78c by switching these signals each time a certain period, for example, 10 ms, passes, and calculates, by a known calculation formula, combined resistances of both the resistivities of the sludge layer 20 and the resistivities of the natural ground portion 67 at the points where the electrode row sets 64a, 64b and 64c are disposed. The combined resistivities are stored in a memory, not shown, and displayed on a display 80. Thereafter, the signal processor 72 operates to output switching signals to the switching devices 70a, 70b and 70c so that the electrodes of each electrode row set 64a, 64b or 64c are successively interchanged to be selected as the detection electrodes, to calculate combined resistivities in a similar manner, and to cause the calculated combined resistivities to be displayed on the display 80. Also, the signal processor operates to produce a two-dimensional or three-dimensional map of the combined resistivities, and to cause the map to be displayed on the display 80 or printed by a printer, not shown.

Further, when all the possible combinations of detection electrodes have been formed by the electrodes other than the selected pair of the conduction electrodes, the signal processor 72 selects a subsequent pair as conduction electrodes, and performs processing similar to the above.

As described above, in this embodiment, currents having mutually different frequencies is supplied to the sludge layer 20, and, from among the detection signals obtained by the detection electrodes, only those detection signals having the same frequencies as the frequencies of the currents are selected, and inputted to the signal processor. In this way, even though currents are simultaneously supplied to the respective conduction electrodes of the electrode row sets 64a, 64b and 64c, the detection signals are prevented from interfering with each other. Also, quick inputting and processing of data is possible. Thus, the condition of the working face detected by the electrode row sets 64a, 64b and 64c can be measured in a real-time manner, thereby enabling changes in the working face to be quickly and correctly coped with.

Although in the above embodiment, the inputting of signals from the amplifiers 78a, 78b and 78c is performed in a time-division manner, simultaneous processing may be effected by, for instance, using a plurality of central processing units. Further, the electrode row sets 64a, 64b and 64c can be arranged at other than equal intervals of angle with respect to the center of the shield machine 60, and the electrode row set 64b can be at a position other than the top portion of the shield machine 10. Still further, the number of electrode row sets is not limited to three. In addition, although the above embodiment illustrates a case in which the conduction electrodes consist of a pair of mutually separated electrodes, the conduction electrodes may consist of a pair of mutually adjacent electrodes.

Figure 12:
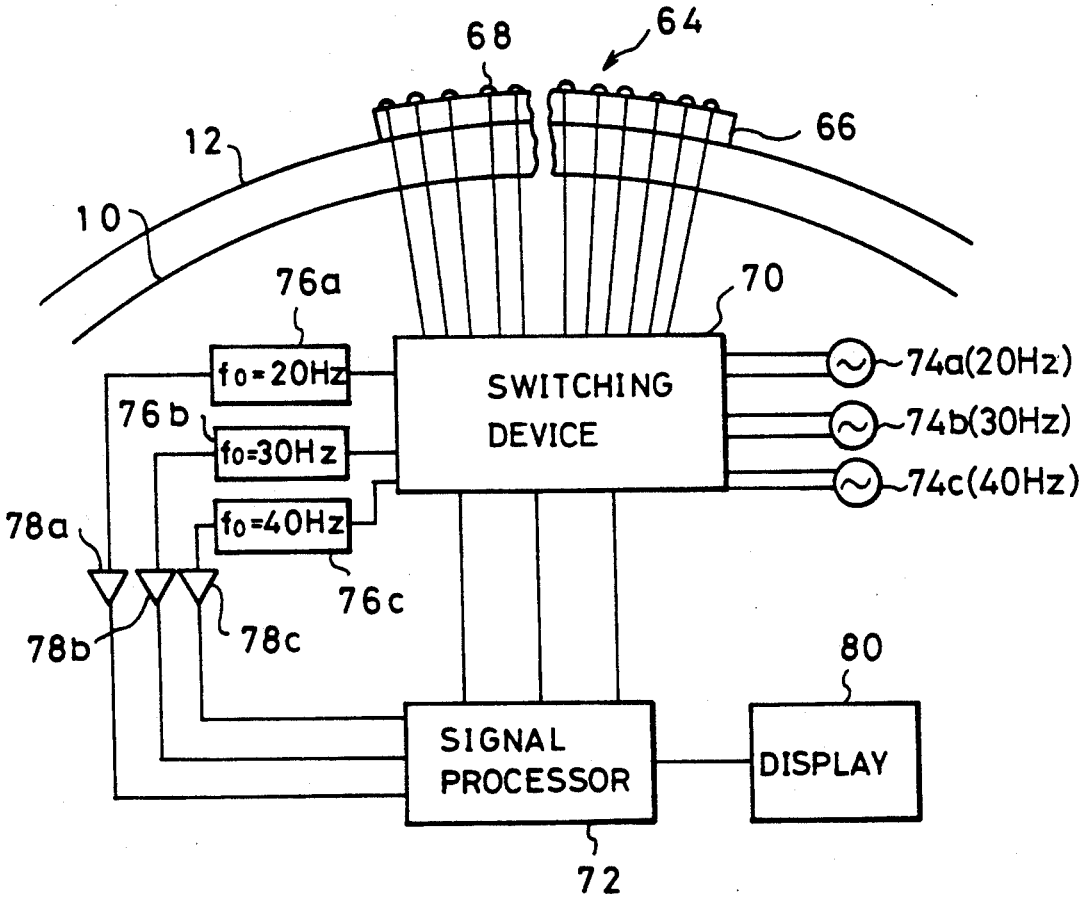
FIG. 12 is a view for illustrating another embodiment of an apparatus of the same type as that shown in FIG. 11.

FIG. 12 shows a example of another construction.

In the embodiment shown in FIG. 12, electrode rows 64 have the same structure as that obtained by integrating the plurality of electrode row sets 64a, 64b and 64c shown in the foregoing embodiment, and electrodes 68 are connected to a single switching device 70. A signal processor 72, connected to the switching device 70, operates to select, as conduction electrodes, three pairs of electrodes from among those in the electrode rows 64, and to connect the selected conduction electrodes to AC sources 74a, 74b and 74c, so that currents are supplied from three different points in the circumferential direction of a shield machine 10 into sludge. The signal processor also operates to successively select three pairs of electrodes from among the remaining electrodes, and to connect them to band filters 76a, 76b and 76c.

This embodiment is capable of providing advantages. similar to those of the foregoing embodiment.

As has been described above, with a method and an apparatus for detecting collapse of natural ground in a shield driving method, the variation ratios of measurement data obtained by a dipole electrode row are calculated while resistivity detection data obtained by a Wenner electrode row serves as the reference, so that the absolute values of certain resistivities as well as the configuration of a collapse of the natural ground can be measured and determined with a high level of precision. In this way, the detection of a collapse of the natural ground in a shield driving method can be accurately performed, which is an excellent advantage.

Further, the variation ratios of the measurement data obtained by the dipole electrode row are calculated while the resistivity detection data obtained by the Wenner electrode row serves as the reference, so that the absolute values of certain resistivities as well as the configuration of a collapse of the natural ground can be measured and determined with a high level of precision, and the ratios can be subjected to contour displaying. In this way, the detection of a collapse of the natural ground in a shield driving method can include visual display of a contour-pattern, thereby enabling accurate collapse detection.

Still further, the variation ratios of the measurement data obtained by the dipole electrode row are calculated while the resistivity detection data obtained by the Wenner electrode row serve as the reference, so that the absolute values of certain resistivities as well as the configuration of a collapse of the natural ground can be measured and determined with a high level of precision, and the ratios can be outputted and displayed as a three-dimensional image. In this way, in a shield driving method, the configuration of the collapse of the natural ground can be easily distinguished and detected by visual sense without requiring any special judging ability, which is another excellent advantage.

In addition, a plurality of electrode row sets are arranged in the circumferential direction, currents having different frequencies are supplied to the electrode row sets, and hence, to sludge, and, from among detection signals indicating voltages based on the current, those detection signals having frequencies according with the frequencies of the current are selected, so that the detection signals can be simultaneously processed. In this way, information on the natural ground which covers a wide range of the working face in the circumferential direction of the shield machine can be quickly obtained, thereby enabling changes in the working face to be quickly and correctly coped with.

What is claimed is:

1. A method for detecting a collapse of natural ground in a shield driving method comprising:

using a measurement electrode row of dipole electrodes and a reference electrode row of Wenner electrodes, which rows are provided on an outer surface of a shield machine;

obtaining a measurement resistivity map from combinations of electrodes in said measurement electrode row and also obtaining a reference resistivity map corresponding to said measurement resistivity map by calculating, from said reference electrode row, certain resistivities of the natural ground and the thickness of a strate boundary; and obtaining a variation ratio map by calculating the ratios of measured values of said measurement resistivity map with respect to calculated values of said reference resistivity map, thereby detecting a collapsed condition of the natural ground.

2. A method for detecting a collapse of natural ground in a shield driving method comprising:

using a measurement electrode row of dipole electrodes and a reference electrode row of Wenner electrodes, which rows are provided on an outer surface of a shield machine;

obtaining a measurement resistivity map from combinations of electrodes in said measurement electrode row and also obtaining a reference resistivity map corresponding to said measurement resistivity map by calculating, from said reference electrode row, certain resistivities of the natural ground, certain resistivities of sludge, and the thickness of a strata boundary;

obtaining a variation ratio map by calculating the ratios of measured values of said measurement resistivity map with respect to calculated values of said reference resistivity map; and obtaining, from orthogonal coordinate values in said variation ratio map, isopleths each connecting equal variation ratios with each other, said isopleths being displayed as an image, thereby detecting a collapsed condition of the natural ground.

3. A method for detecting a collapse of natural ground in a shield driving method comprising:

using a measurement electrode row of dipole electrodes and a reference electrode of Wenner electrodes, which rows are provided on an outer surface of a shield machine;

obtaining a measurement resistivity map from combinations of electrodes in said measurement electrode row and also obtaining a reference resistivity map corresponding to said measurement resistivity map by calculating, from said reference electrode row, certain resistivities of the natural ground, certain resistivities of sludge, and the thickness of a strata boundary;

obtaining a variation ratio map by calculating the ratios of measured values of said measurement resistivity map with respect to calculated values of said reference resistivity map; and obtaining, from orthogonal coordinate values in said variation ratio map, isopleths each connecting equal variation ratios with each other, the configuration of the measured boundary layer being displayed as a three-dimensional image on three-dimensional coordinate planes by a computer algorithm on the basis of data on said isopleths and data on the intervals between said isopleths.

4. A method for detecting a collapse of natural ground in a shield driving method which is adapted to detect resistivities by supplying current to sludge on the periphery of a shield machine, and to detect any collapse of the natural ground on the basis of changes in the resistivities, said method comprising:

supplying into the sludge form a plurality of points on an outer surface of the shield machine a corresponding plurality of currents, each of said currents having a frequency different from the frequencies of the remaining currents; and obtaining voltage detection signals, each of said voltage detection signals having the same frequency as a respective one of said currents, thereby detecting resistivities at said plurality of points.

5. An apparatus for detecting a collapse of natural ground in a shield driving method comprising: a measurement electrode row of dipole electrodes and a reference electrode row of Wenner electrodes, which rows are provided on a surface of a shield machine and connected to a constant supply source and a measuring device, said constant supply source being one of a constant current supply source and a constant voltage supply source, said measuring device being a voltage measuring device when said constant supply source is a constant current supply source and being a current measuring device when said constant supply source is a constant voltage supply source; reference signal calculating means for inputting a measurement signal from said reference electrode row, and for calculating a reference resistivity map by calculating certain resistivities of the natural ground and the thickness of a strata boundary; measurement signal calculating means for inputting a signal from said measurement electrode row, and for calculating a measurement resistivity map; and signal processing means for calculating the respective ratios between values of said measurement resistivity map and values of said reference resistivity map corresponding to said measurement resistivity map, and for transforming said ratios into a variation ratio map.

6. An apparatus for detecting a collapse of natural ground in a shield driving method according to claim 5, wherein said measurement electrode row of dipole electrodes and said reference electrode row of Wenner electrodes are disposed parallel with each other.

7. An apparatus for detecting a collapse of natural ground in a shield driving method according to claim 5, wherein said measurement electrode row of dipole electrodes and said reference electrode row of Wenner electrodes are disposed perpendicular to each other.

8. An apparatus for detecting a collapse of natural ground in a shield driving method according to claim 5, wherein said signal processing means has means for calculating isopleths from said variation ratio map containing said ratios between said values of said measurement resistivity map and said values of said corresponding reference resistivity map, and for outputting said isopleths.

9. An apparatus for detecting a collapse of natural ground in a shield driving method according to claim 8, wherein said means for calculating isopleths and for outputting said isopleths is connected with an image display means.

10. An apparatus for detecting a collapse of natural ground in a shield driving method comprising: electrode rows composed of conduction electrodes and detection electrodes, and arranged in correspondence with a plurality of points on an outer surface of a shield machine; a plurality of power sources connected to the conduction electrodes of said electrode rows, each said power source supplying a current to a respective pair of said conduction electrodes of said electrode rows, each of the currents having a frequency differing form the frequencies of the other currents; a plurality of filters connected to the detection electrodes of said electrode rows, said filters allowing the passage therethrough of voltage detection signals having the same frequencies as those of the current supplied to the associated pair of conduction electrodes; and a signal processing means for calculating, on the basis of outputs of said filters, resistivities at said plurality of points in the circumferential direction of said shield machine.

* * * * *